US008100265B2

(12) United States Patent
Farley

(10) Patent No.: US 8,100,265 B2
(45) Date of Patent: Jan. 24, 2012

(54) DISPENSER BOX WITH TILTED TOP SURFACE AND TIPPING CORNER

(75) Inventor: David Farley, Carona, CA (US)

(73) Assignee: FXI, Inc., Media, PA (US)

( * ) Notice: Subject to any disclaimer, the term of this patent is extended or adjusted under 35 U.S.C. 154(b) by 0 days.

(21) Appl. No.: 12/879,977

(22) Filed: Sep. 10, 2010

(65) Prior Publication Data

US 2011/0062181 A1 Mar. 17, 2011

Related U.S. Application Data

(60) Provisional application No. 61/241,889, filed on Sep. 12, 2009.

(51) Int. Cl.

| | |
|---|---|
| ***B65D 5/50*** | (2006.01) |
| ***B65D 85/20*** | (2006.01) |
| ***B65D 75/58*** | (2006.01) |
| ***A47F 1/04*** | (2006.01) |
| ***A47F 7/16*** | (2006.01) |

(52) U.S. Cl. ..... 206/763; 206/326; 206/391; 206/443; 206/739; 206/762; 211/60.1; 211/70.1

(58) Field of Classification Search ..... 206/326, 206/391, 393, 443, 446, 736–739, 756–765; 211/60.1, 65, 68–70.8

See application file for complete search history.

(56) References Cited

U.S. PATENT DOCUMENTS

| | | | | | |
|---|---|---|---|---|---|
| 1,715,048 | A * | 5/1929 | Townsend | 211/60.1 |
| 2,019,953 | A * | 11/1935 | Curtis | 206/763 |
| 4,076,116 | A * | 2/1978 | Sowders | 206/443 |
| 4,397,395 | A * | 8/1983 | McKelvey | 211/69 |
| 4,947,984 | A * | 8/1990 | Kaufman et al. | 206/739 |
| 5,165,534 | A * | 11/1992 | Kaufman et al. | 206/739 |
| 5,186,319 | A * | 2/1993 | Ting | 206/763 |
| 5,573,115 | A * | 11/1996 | Fuller | 211/65 |
| 5,617,960 | A * | 4/1997 | Bishop | 211/60.1 |
| 5,755,325 | A * | 5/1998 | Willhite et al. | 206/443 |
| 6,530,487 | B1 * | 3/2003 | Berry | 211/60.1 |
| 6,755,311 | B2 * | 6/2004 | Berry | 211/65 |
| 6,920,987 | B2 * | 7/2005 | Siegel et al. | 211/70.6 |
| 7,213,707 | B2 * | 5/2007 | Hubbs et al. | 206/443 |

* cited by examiner

*Primary Examiner* — Bryon Gehman

(74) *Attorney, Agent, or Firm* — Connolly Bove Lodge & Hutz LLP

(57) ABSTRACT

A dispenser box that includes a tilted or inclined top surface that defines a plurality of object wells that are configured to receive objects and secure them for shipping as well as display. The object wells are configured to secure each object on display as the objects are removed from the dispenser box, such that the last remaining object may continue to stand secure and in place.

20 Claims, 6 Drawing Sheets

DISPENSER BOX WITH TILTED TOP SURFACE AND TIPPING CORNER

This application claims the benefit and priority of U.S. Provisional Application No. 61/241,889, filed on Sep. 12, 2009, which is herein incorporated by reference in its entirety for all purposes.

BACKGROUND

1. Field

This invention relates to a dispenser box, and more particularly to a dispenser box having a tilted top surface and tipping corner to facilitate the dispensing of upright objects.

2. Related Art

There are concerns related to the safety of consumers who need to collect heavy objects from palletized loads in a warehouse store scenario. Typically, heavy objects need to be lifted above the edges of the display box, without damaging the supporting structure of the display box or the display box signage. Tall upright objects are usually even more difficult to collect and place into store handcarts or baskets, not only because of weight considerations, but size as well. Moreover, as objects are removed from the pallets, the stability of the remaining objects may be diminished.

SUMMARY

The present disclosure provides a dispenser box that includes a tilted or inclined top surface that defines a plurality of object wells that are configured to receive objects and secure them for shipping as well as display. The object wells are configured to secure each object on display as the objects are removed from the dispenser box, such that the last remaining object may continue to stand secure and in place.

The present invention also includes a tear-away section on the tilted top surface that facilitates the removal of each object from the dispenser box. The tear-away section allows the dispenser box to maintain structural integrity while allowing objects to be removed therefrom without the need for lifting the objects out from the object wells. The dispenser box also includes a strengthened and lowered 'tipping corner' which also facilitates the removal of the objects which may be tilted and retrieved without the need for substantial lifting of the object over the side edge of the dispenser box.

This invention helps protect consumers from potential back strain when pulling heavy items from display packaging in "yard" or warehouse retail settings and also serves to protect consumers from objects that might be inclined to fall off of partially empty palletized loads. The dispenser box may be stackable with its top cover and banding installed at the point of manufacture.

In one aspect, a dispenser box is provided including a dispenser box body having a flat bottom and a tilted top surface and corresponding side walls each extending up from the flat bottom and terminating at an edge of the tilted top surface. The dispenser box also includes a plurality of object wells defined on the tilted top surface for receiving and securing an object, and a secondary surface disposed within confines of the dispenser box body. The secondary surface is positioned above the flat bottom, and includes a plurality of collapsible skirts each positioned beneath a corresponding opening of the object wells. A tipping corner is provided that is structurally strengthened to allow the object to be tilted towards and onto the tipping corner without the tipping corner collapsing under the weight of the object.

In another aspect, a dispenser box is provided including a dispenser box body having a flat bottom and a tilted top surface and corresponding side walls each extending up from the flat bottom and terminating at an edge of the tilted top surface; and a plurality of object wells defined on the tilted top surface for receiving and securing an object. The object wells each define a circular shaped hole that is configured to receive the objects. The inclined top surface defines a tear-away section adjacent to each object well to allow a portion of the tilted top surface between the object wells to separate when placed under a load. A secondary surface is disposed within confines of the dispenser box body, and positioned above the flat bottom. The secondary surface includes a plurality of collapsible skirts each positioned beneath a corresponding opening of the object wells, where each collapsible skirt has a skirt opening configured to receive the object with an interference fit. A tipping corner is included that is structurally strengthened to allow the object to be tilted towards and onto the tipping corner without the tipping corner collapsing under the weight of the object.

In another aspect, a method is provided for manufacturing a dispenser box. The method includes forming a dispenser box body having a flat bottom and a tilted top surface and corresponding side walls each extending up from the flat bottom and terminating at an edge of the tilted top surface; forming a plurality of object wells on the tilted top surface for receiving and securing an object, the object wells each defining circular shaped holes that are configured to receive the objects; forming a tear-away section adjacent to each object well to allow a portion of the tilted top surface between the object wells to separate when placed under a load; positioning a secondary surface within the confines of the dispenser box body above the flat bottom, the secondary surface including a plurality of collapsible skirts each positioned beneath a corresponding opening of the object wells; and providing a tipping corner that is structurally strengthened to allow the object to be tilted towards and onto the tipping corner without the tipping corner collapsing under the weight of the object.

A more complete understanding of the disclosure may be obtained by reference to the following detailed description of the embodiments thereof in connection with the attached drawings.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION

Figure 1:
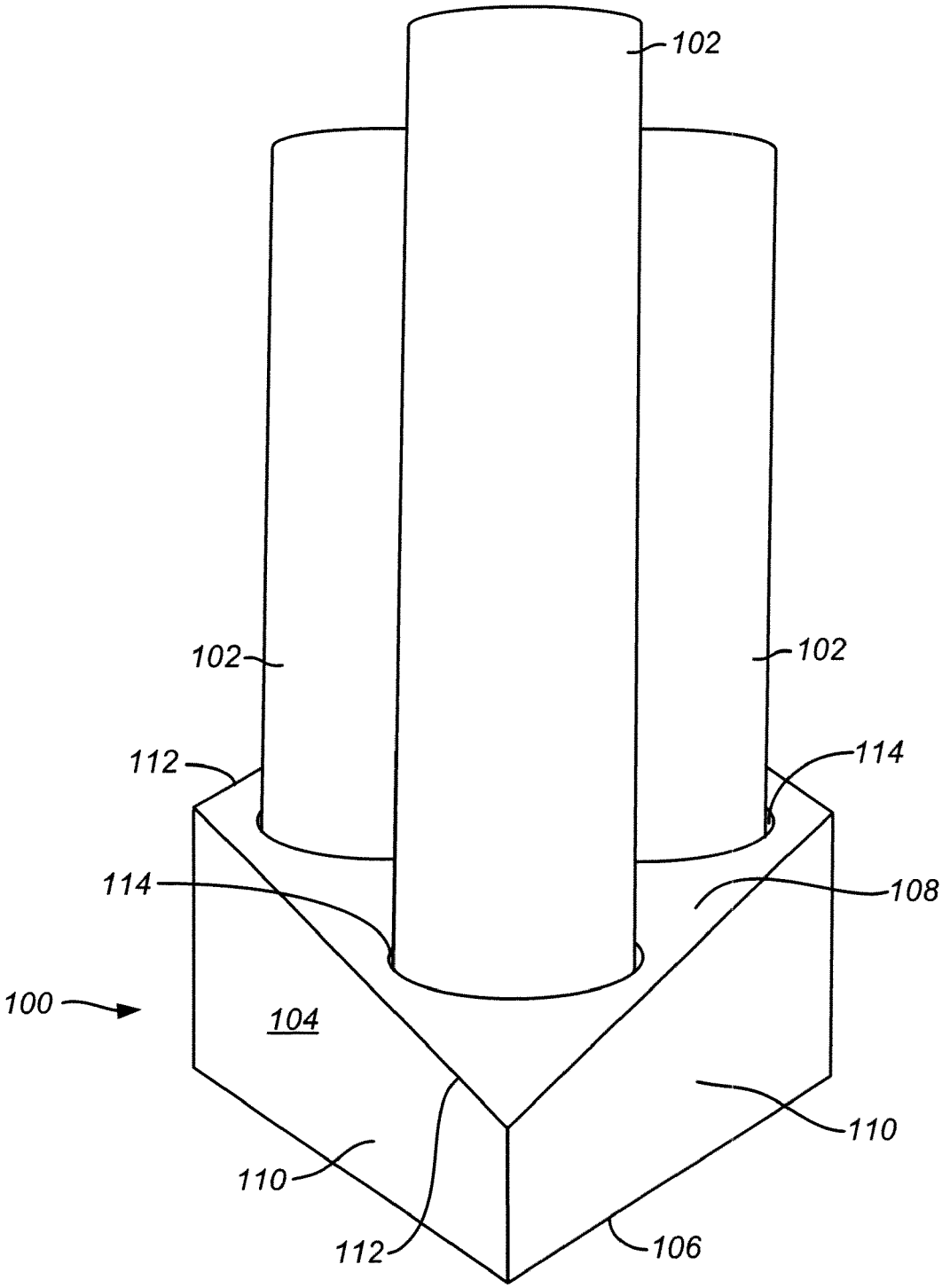
FIG. 1 is a simplified perspective view of a dispenser box with an object load in accordance with an embodiment of the present invention.

FIG. 1 is s simplified illustration of a dispenser box 100 including a load of palletized objects 102 in accordance with an embodiment. For example, without any intent to be limiting, the objects shown in the figures are bagged compression rolled mattresses. It should be understood that any objects that are stored and displayed similarly in an upright manner may be accommodated.

In one embodiment, the dispenser box 100 is a square box shaped body 104 having a flat bottom 106, a tilted top surface 108 and corresponding side walls 110 each extending up from the flat bottom 106 and terminating at an edge 112 of the tilted top surface 108. In one embodiment, the dispenser box 100 is made of corrugated cardboard, but may be made of any equivalent material capable of allowing the dispenser box 100 to function as described. In one embodiment, the box shaped body 104 and the tilted top surface 108 may be made of different materials. For example, the box shaped body may be made of a plastic material and the tilted top surface 108 may be made of corrugated cardboard or the like.

In one embodiment, although described as a square box, it should be understood that the dispenser box 100 may take any geometrical shape that can accommodate the objects to be dispensed and provide the desired stability of the dispenser box.

Figure 2:
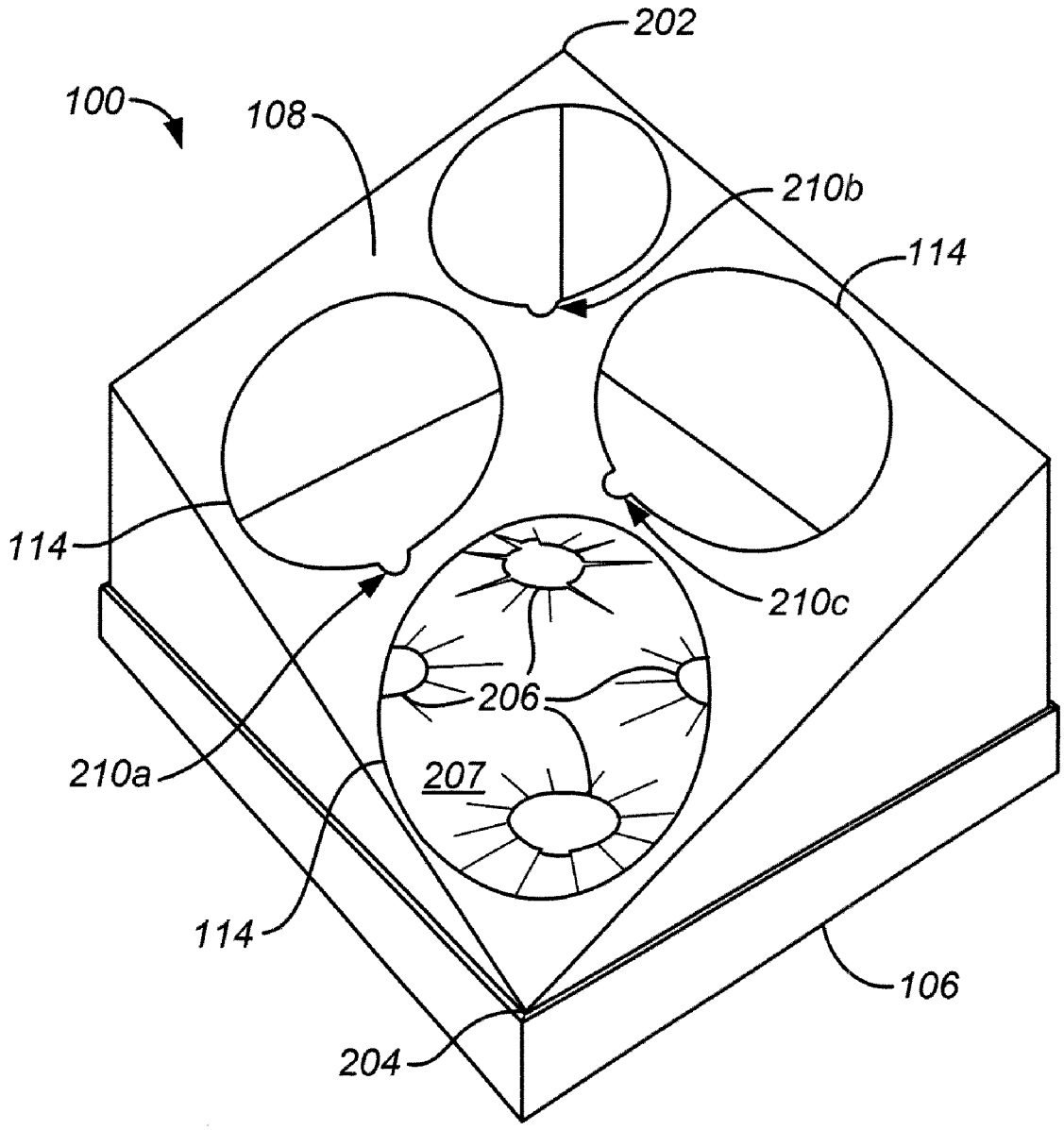
FIG. 2 is a top perspective view of a dispenser box in accordance with an embodiment of the present invention.
Figure 3:
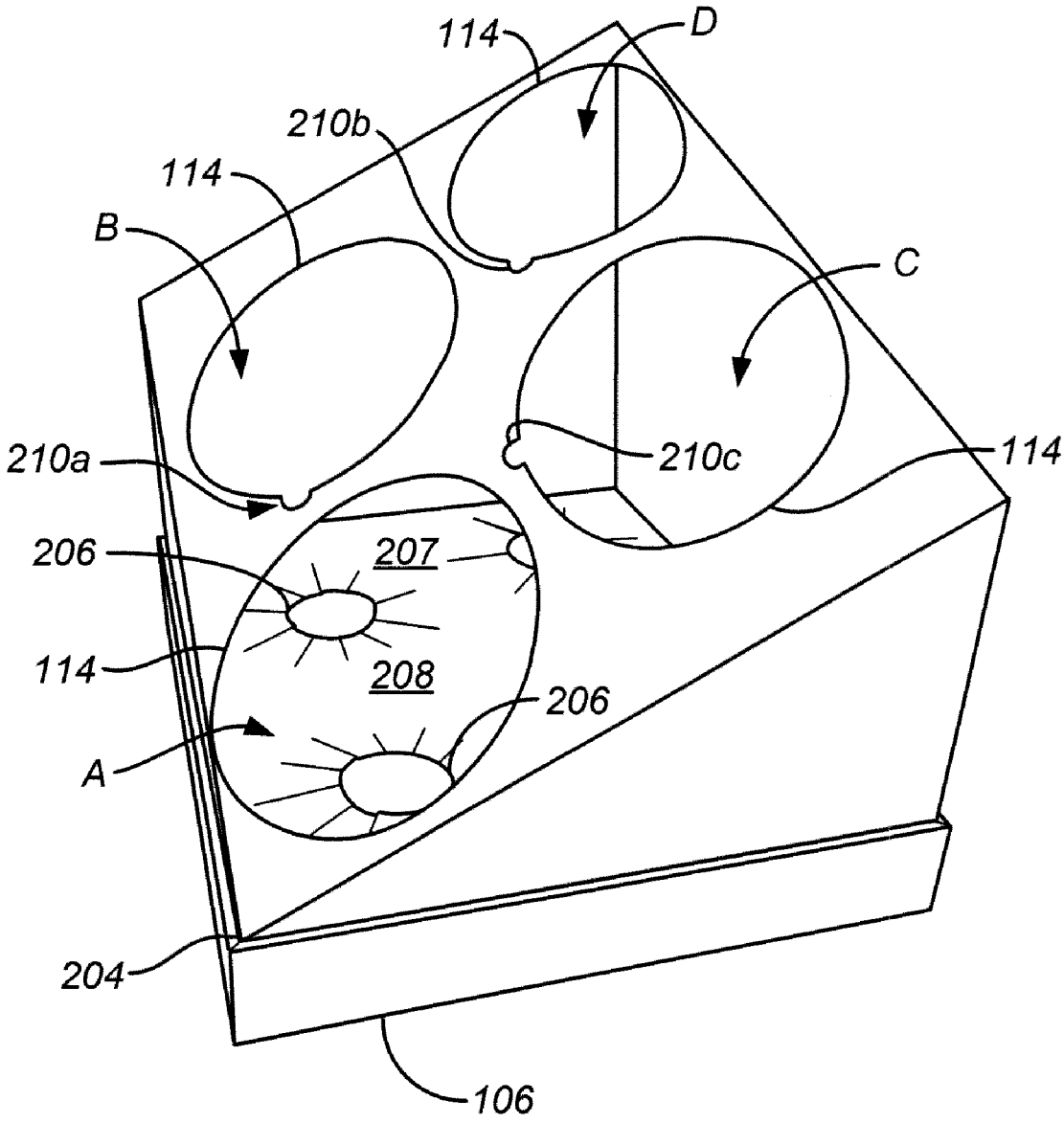
FIG. 3 is a side perspective view of the dispenser box of FIG. 2 in accordance with an embodiment of the present invention.

Referring now to FIGS. 1, 2 and 3, the dispenser box 100 includes a plurality of object wells 114 defined on the tilted surface 108 for receiving and securing an object. In one embodiment, the object wells 114 are circular shaped holes that are configured to receive the objects 102. In one embodiment, the objects 102 are cylindrically shaped objects. It should be understood however, that the object wells 114 may be formed with any suitable geometry, such as oval, square, triangular and the like, to accommodate other geometrically shaped objects.

The tilted or inclined surface 108 extends from one corner of the box shaped body 104 to an opposed corner. As shown in FIGS. 2 and 3 (no objects shown in place for clarity), the highest corner on the inclined surface 108 is the rear corner 202. The inclined surface 108 slopes down from the rear corner 202 towards a front corner 204. The inclined surface 108 may be sloped at any suitable angle, from between 0 and 75 degrees, preferably between 40 and 60 degrees, for example 45 degrees.

Front corner 204 is also referred to as tipping corner 204. The front or tipping corner 204 is structurally strengthened to allow the object 102 to be tilted towards and onto the front corner 204 without the front corner 204 collapsing under the weight of the object. As described below, when an object is tilted onto the front corner 204, the front corner provides a fulcrum upon which the object 102 may be pivoted to facilitate removal of the object from the dispenser box 100. In some embodiments, tipping corner 204 may be made of a different material from the inclined surface 108.

In one embodiment, as shown in FIGS. 2 and 3, dispenser box 100 may include a secondary surface 207 disposed or inserted within the dispenser box, positioned above the flat bottom 106. The secondary surface 207 includes a plurality of collapsible skirts 206, each positioned beneath a corresponding opening of the object wells 114. Each collapsible skirt 206 has a skirt opening with a skirt diameter (or perimeter) that is less than the diameter of object 102 but configured to receive the object 102 with an interference or friction fit. In one embodiment, the portion of the secondary surface 207 immediately adjacent the skirt opening may be scored or similarly configured so as to be collapsible. When the object 102 is positioned into the object wells 114, the bottom end of the object 102 penetrates into the skirt opening to ultimately rest on the flat bottom 106. The collapsible portion of the collapsible skirt 206 collapses against the object to secure the object with the interference or friction fit.

Referring now to FIG. 2, the inclined surface 108 also defines tear-away sections 210*a*, 210*b* and 210*c*. The tear-away sections are portions of the inclined surface adjacent to each object well 114 that are scored, removed or otherwise weakened to allow the material between the rear object wells B, C and D (FIG. 3) and the front object well A to separate or break when placed under a particular load. The tear away section is generally positioned between the object wells. This facilitates the movement of the object from one object well to another object well as the object is moved toward the tipping corner 204 as described below.

Figure 4:
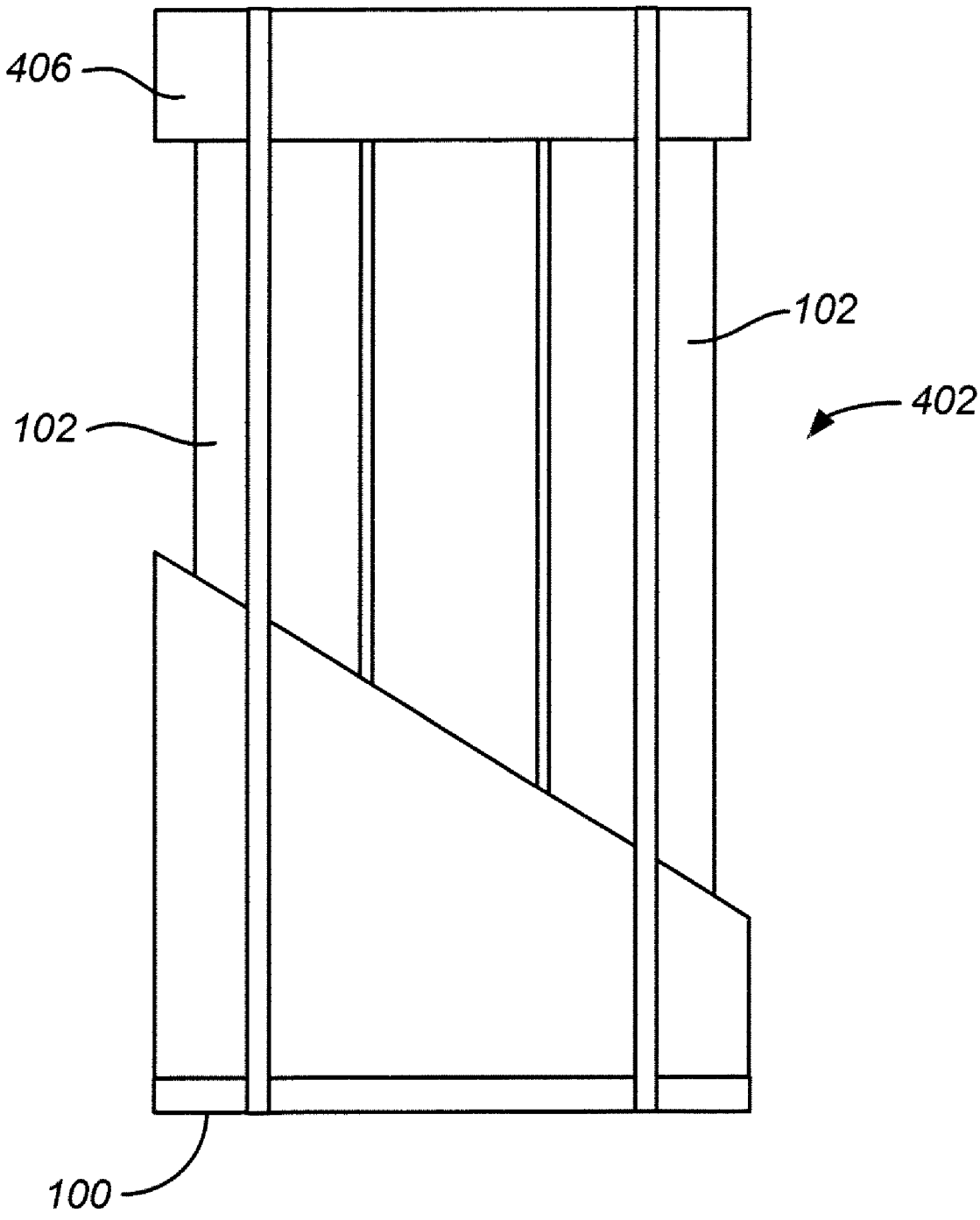
FIG. 4 is an exemplary illustration of a dispenser box and a cover in accordance with an embodiment of the present invention.
Figure 5:
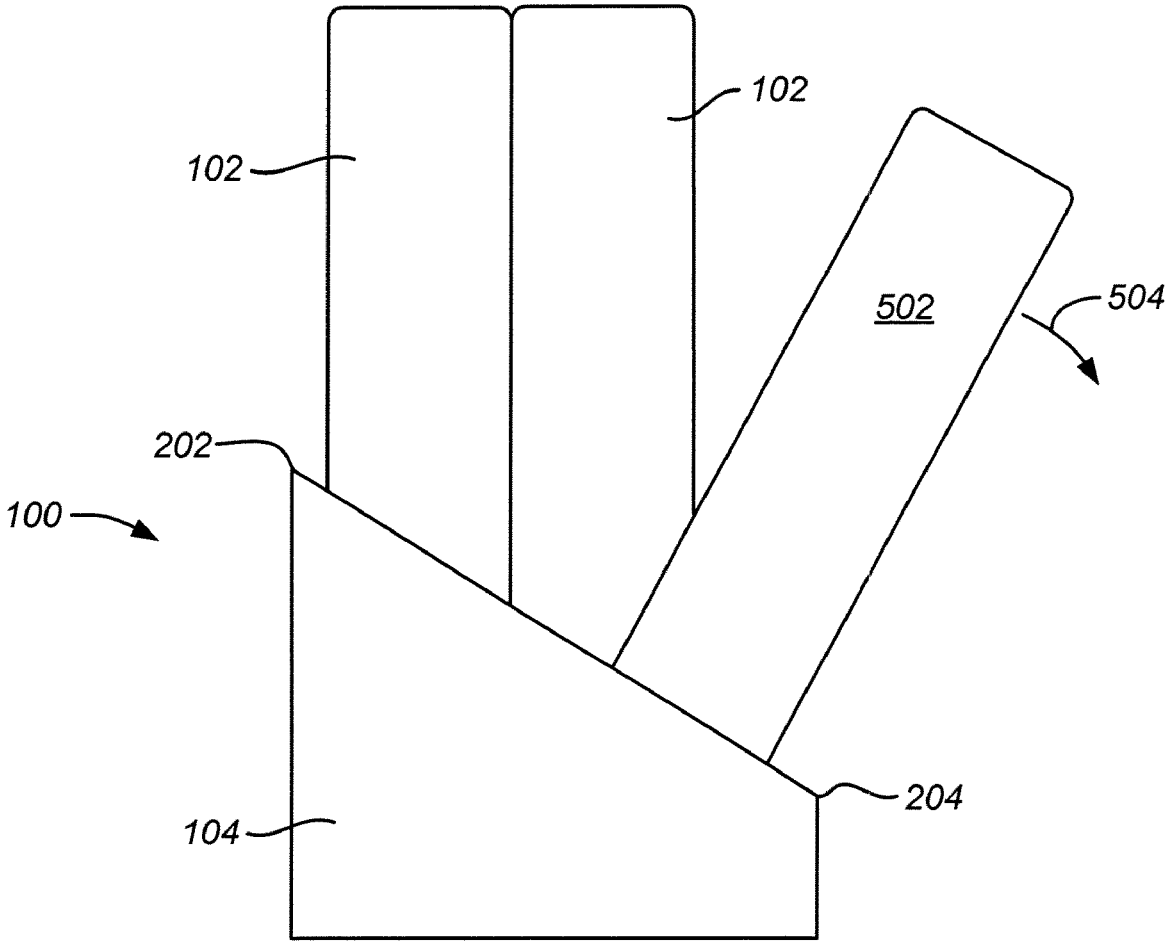
FIG. 5 is an exemplary illustration of a dispenser box in accordance with an embodiment of the present invention.
Figure 6:
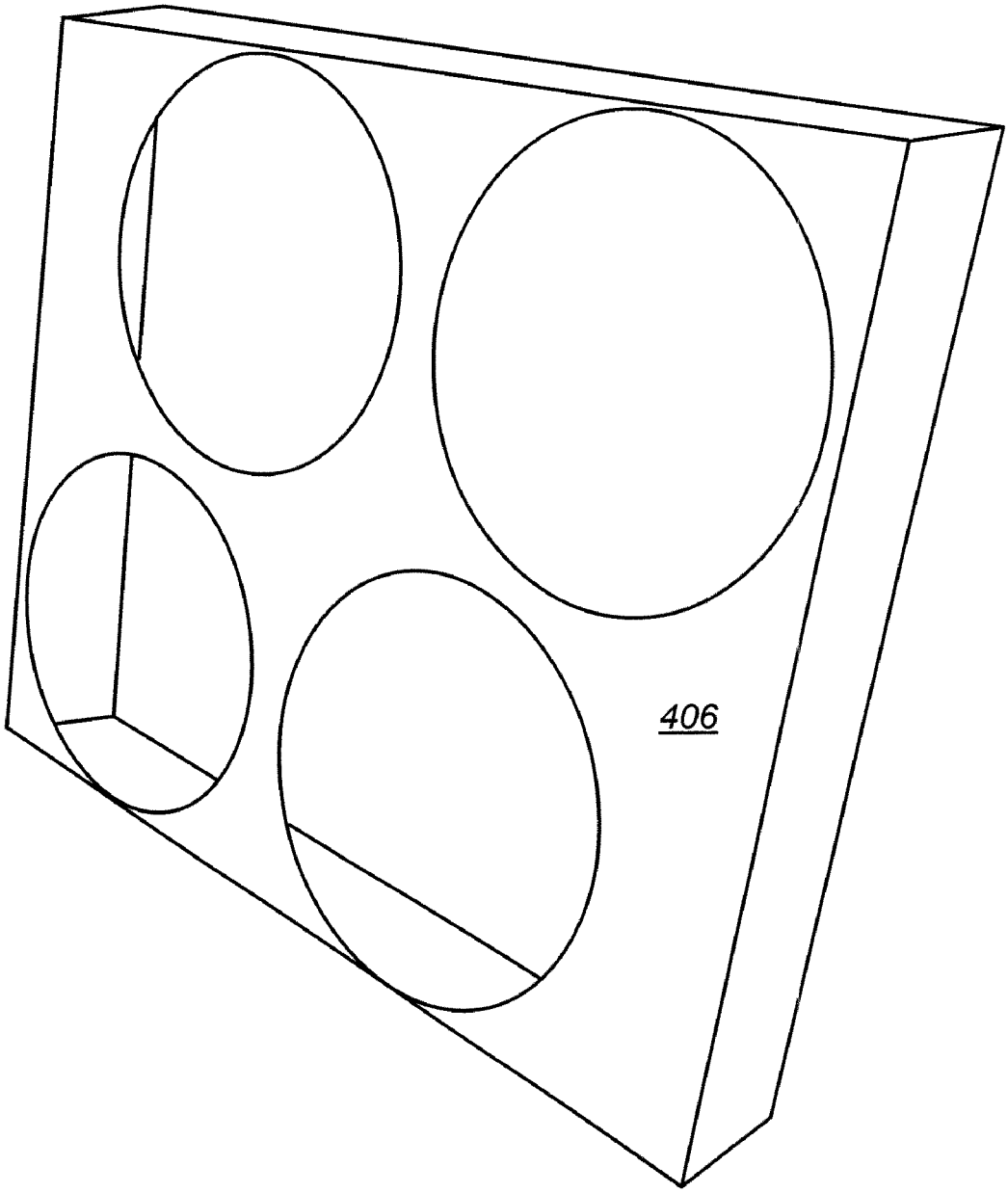
FIG. 6 is an exemplary illustration of a cover in accordance with an embodiment of the present invention.

Referring now to FIGS. 4 and 5, in operation the palletized load 402 arrives at its intended destination having a cover or securing mechanism 406 placed over the objects being shipped. Each of the objects 102 is appropriately secured within the cover 406. In one embodiment, the cover may resemble the dispenser box body 104 and tilted surface 108 albeit inverted to be placed over the tops of the objects 102. FIG. 6 is an illustration of an embodiment of the securing mechanism or cover 406.

Once cover 406 has been removed from the objects, the dispenser box 100 is suitable for display (see e.g. FIG. 1). In this embodiment, each of the objects 102 are cylindrically shaped objects that are placed upright, on end, within the object wells 114. The bottom end of each of the objects is held in skirts 206 and seated on the flat bottom 106. For ease of discussion and to distinguish between the object wells, the object wells 114 may be referred to as wells A, B, C and D as labeled in FIG. 3.

As shown in FIG. 5, a consumer interested in purchasing one of the objects 102 approaches the dispenser box 100 and pulls object 102 in well A downward towards tipping corner 204. The tipping corner 204 acts as a fulcrum to pivot the cylindrical object 102 out from well A and onto a waiting cart, floor or other surface. Because the tipping corner 204 has been strengthened and reinforced, the tipping corner does not crush or collapse under the weight of the object 102.

Once the object in well A is removed, the remaining objects 102 in wells B, C and D are kept stable because of the sloping height of the tilted surface 108 and the proximity of the remaining objects 102 to each other.

A consumer who next approaches the dispenser box 100 to remove an object 102 may choose to remove either object 102 from well B or from well C. As before, the consumer reaches and grabs the object and pulls the object towards the tipping corner 204. The weight of the object being pulled toward the tipping corner 204 causes the appropriate tear-away section on the inclined surface to separate, break away or "tear." Similarly, the collapsible portion of the collapsible skirt 206 is crushed under the weight of the tipping object to allow the object to be removed from the corresponding skirt. This allows the object to move into well A and towards the tipping corner 204 without the object having to be lifted out from within the object well 114.

For example, as shown in FIG. 5, to remove object 502 from well B (FIG. 3), object 502 is pulled toward tipping corner 204 (arrow 504). While being pulled toward the tipping corner 204, the weight of object 502 causes the tear-away section 210*a* (FIG. 3) to separate allowing the object 502 to move toward the tipping corner. Once at the tipping corner the object 502 may be removed by pivoting the object over the tipping corner. As before, the remaining objects remain secure and stable in their respective object wells.

While the present invention has been shown and described with reference to specific embodiments thereof, it will be understood by those skilled in the art that various changes in form and details may be made therein without departing from the spirit and scope of the invention.

What is claimed is:

1. A dispenser box comprising:

a dispenser box body having a flat bottom and a tilted top surface and one or more corresponding side walls each extending up from the flat bottom and terminating at an edge of the tilted top surface;

a plurality of object wells defined through the tilted top surface, each said object well adapted for receiving and securing a corresponding object;

a secondary surface disposed within confines of the dispenser box body, and positioned above the flat bottom, the secondary surface including a plurality of collapsible skirts with each said collapsible skirt positioned beneath a corresponding opening of one of the object wells; and a tipping corner that is structurally strengthened greater than the remainer of the dispenser box body to allow an object secured in one of said object wells to be tilted towards and onto the tipping corner without the tipping corner collapsing under the weight of the object.

2. The dispenser box of claim 1, wherein the object wells are configured to hold and support bagged compression rolled mattresses.

3. The dispenser box of claim 1, wherein the dispenser box body comprises corrugated cardboard.

4. The dispenser box of claim 1, wherein the bottom and side walls of the dispenser box body comprise a first material and the tilted top surface comprises a second material, wherein the first material is different from the second material.

5. The dispenser box of claim 1, wherein the object wells comprise circular shaped holes that are configured to receive cylindrical shaped objects.

6. The dispenser box of claim 1, wherein the tilted top surface comprises a slope from between 40 and 60 degrees.

7. The dispenser box of claim 1, wherein the tipping corner comprises a different material from a remainder of the dispenser box body.

8. The dispenser box of claim 1, wherein each collapsible skirt has a skirt opening with a skirt diameter that is less than a longest width or outer diameter dimension of the corresponding object, with said skirt opening configured to receive the corresponding object with an interference or friction fit.

9. The dispenser box of claim 8, wherein a portion of the secondary surface immediately adjacent the skirt opening is scored so as to be collapsible.

10. The dispenser box of claim 1, wherein the tilted top surface defines one or more tear-away sections adjacent to each object well to allow material of the top surface between the object wells to separate when placed under a load.

11. The dispenser box of claim 1, further comprising a cover configured to be placed over one or more objects received in the object wells.

12. A dispenser box comprising:

a dispenser box body having a flat bottom and a tilted top surface and one or more corresponding side walls each extending up from the flat bottom and terminating at an edge of the tilted top surface;

a plurality of object wells defined through the tilted top surface, each said object well adapted for receiving and securing a corresponding object, the object wells each defining circular shaped holes that are configured to receive the objects, the tilted top surface defining at least one tear-away section adjacent to each object well to allow a portion of the tilted top surface between the object wells to separate when placed under a load;

a secondary surface disposed within confines of the dispenser box body, and positioned above the flat bottom, the secondary surface including a plurality of collapsible skirts with each said collapsible skirt positioned beneath a corresponding opening of one of the object wells, each collapsible skirt having a skirt opening configured to receive the corresponding object with an interference fit; and a tipping corner that is structurally strengthened to allow an object secured in one of said object wells to be tilted towards and onto the tipping corner without the tipping corner collapsing under the weight of the object.

13. The dispenser box of claim 12, wherein the object wells are configured to hold and support bagged compression rolled mattresses.

14. The dispenser box of claim 12, wherein the dispenser box body comprises corrugated cardboard.

15. The dispenser box of claim 12, wherein the flat bottom and side walls of the dispenser box body comprise a first material and the tilted top surface comprises a second material, wherein the first material is different from the second material.

16. The dispenser box of claim 12, wherein the tilted surface comprises a slope from between 40 and 60 degrees.

17. The dispenser box of claim 12, wherein the tipping corner comprises a different material from a remainder of the dispenser box body.

18. The dispenser box of claim 12, wherein a portion of the secondary surface immediately adjacent the skirt opening is scored so as to be collapsible.

19. A method of manufacturing a dispenser box comprising:

forming a dispenser box body having a flat bottom and a tilted top surface and one or more corresponding side walls each extending up from the flat bottom and terminating at an edge of the tilted top surface;

forming a plurality of object wells through the tilted top surface each said object well adapted for receiving and securing a corresponding object, the object wells each defining circular shaped holes that are configured to receive the objects;

forming at least one tear-away section adjacent to each object well to allow a portion of the tilted top surface between the object wells to separate when placed under a load;

positioning a secondary surface within the confines of the dispenser box body above the flat bottom, the secondary surface including a plurality of collapsible skirts with each collapsible skirt positioned beneath a corresponding opening of one of the object wells; and providing a tipping corner that is structurally strengthened to allow an object secured in one of the object wells to be tilted towards and onto the tipping corner without the tipping corner collapsing under the weight of the object.

20. The method of claim 19, wherein the object wells are configured to hold and support bagged compression rolled mattresses.

* * * * *

UNITED STATES PATENT AND TRADEMARK OFFICE

CERTIFICATE OF CORRECTION

PATENT NO. : 8,100,265 B2
APPLICATION NO. : 12/879977
DATED : January 24, 2012
INVENTOR(S) : David Farley It is certified that error appears in the above-identified patent and that said Letters Patent is hereby corrected as shown below:

On the title page, Item [75] the city of the residence of the inventor is "Corona," not "Carona."

Column 5, line 5, the Claim should read as follows:

1. A dispenser box comprising:

a dispenser box body having a flat bottom and a tilted top surface and one or more corresponding side walls each extending up from the flat bottom and terminating at an edge of the tilted top surface;

a plurality of object wells defined through the tilted top surface, each said object well adapted for receiving and securing a corresponding object;

a secondary surface disposed within confines of the dispenser box body, and positioned above the flat bottom, the secondary surface including a plurality of collapsible skirts with each said collapsible skirt positioned beneath a corresponding opening of one of the object wells; and a tipping corner that is structurally strengthened greater than the [[remainer]] <u>remainder</u> of the dispenser box body to allow an object secured in one of said object wells to be tilted towards and onto the tipping corner without the tipping corner collapsing under the weight of the object.

Signed and Sealed this
Eighteenth Day of September, 2012

David J. Kappos

David J. Kappos
*Director of the United States Patent and Trademark Office*